United States Patent [19]

Stewart, Sr.

[11] Patent Number: 4,793,640

[45] Date of Patent: Dec. 27, 1988

[54] CAM-ACTUATED ELECTRIC DOOR LOCK

[75] Inventor: Kenneth W. Stewart, Sr., Columbus, Miss.

[73] Assignee: United Technologies Electro Systems, Inc., Columbus, Miss.

[21] Appl. No.: 925,054

[22] Filed: Oct. 30, 1986

[51] Int. Cl.[4] ..... F05C 3/06

[52] U.S. Cl. ..... 292/201; 74/436; 292/199; 292/336.3; 292/DIG. 62

[58] Field of Search ..... 292/201, 336.3, 112, 292/160, 172, 142, 199, DIG. 62, 144; 70/264, 279; 74/435–437, 820

[56] References Cited

U.S. PATENT DOCUMENTS

| | | | |
|---|---|---|---|
| 1,133,332 | 3/1915 | Standfest | 292/199 X |
| 1,511,956 | 10/1924 | Flagg | 292/172 |
| 2,797,589 | 7/1957 | Chaveneaud | 74/436 |
| 3,541,874 | 11/1970 | Du Rocher | 70/279 |
| 4,093,289 | 6/1978 | Inabayashi et al. | 292/336.3 |
| 4,102,213 | 7/1978 | Smith | 74/110 |
| 4,290,634 | 9/1981 | Gelhard | 292/201 |
| 4,315,649 | 2/1982 | Lutz | 292/201 |
| 4,387,918 | 6/1983 | Dunphy et al. | 292/199 X |
| 4,438,962 | 3/1984 | Soloviff et al. | 292/144 |
| 4,520,914 | 6/1985 | Kagiyama et al. | 70/279 X |
| 4,573,723 | 3/1986 | Morita et al. | 292/336.3 |
| 4,625,848 | 12/1986 | Meyers et al. | 292/201 X |

FOREIGN PATENT DOCUMENTS

| | | | |
|---|---|---|---|
| 471855 | 7/1914 | France | 292/172 |
| 312794 | 11/1933 | Italy | 292/199 |
| 12822 | of 1905 | United Kingdom | 292/172 |

*Primary Examiner*—Lloyd A. Gall

[57] ABSTRACT

A door lock system for a motor vehicle including a latching and locking means is disclosed. A cam means is driven about a pivot point by the engagement of gear projections with a slot in the cam means to effect locking and unlocking of the door lock. The cam means and the gear projections are separated once the door lock is in the locked or unlocked position to allow the door lock to be manually displaced without necessitating the rotational translation of the gear or the electric motor driving the gear.

10 Claims, 4 Drawing Sheets

CAM-ACTUATED ELECTRIC DOOR LOCK

BACKGROUND OF THE INVENTION

The present invention is directed to an electric door lock actuator of the type used in an automobile to lock and unlock the latching bolts in the automobile door. More particularly, the present invention is directed to a cam mechanism cooperating with projections on a driven gear to effect locking and unlocking motion and to allow for manual displacement of the lock mechanism and cam without necessitating displacement of the armature of the electric motor which drives the actuator.

In many currently used electric door lock mechanisms, an electric motor armature, gears and portions of the drive train are mechanically coupled to the locking mechanism. A typical system includes a latching bolt to secure the door to the frame of the automobile, an electric motor located on the inside of the door for locking or unlocking the bolt, a manually-displaceable handle inside of the door for unlatching the door, a manually-movable button, slide or similar device for locking and unlocking a latching bolt in the door, and on the exterior of the door, a handle for latching and unlatching the door and a key opening for the receipt of a key for unlocking or locking the latching bolts. The key receiving mechanism may be designed either manually to unlock the latching bolts or to energize a motor to unlock the latching bolts. At this point in time most key entry locks utilize the motion imparted by turning the key to unlock the latching bolts.

One of the problems identified with this type of system is that the manual effort required to turn the key to unlock the latching bolt may be significant. If the ambient temperature is low, or there is insufficient lubrication, or a key is particularly weak, in any of the above events, the force required to manually unlock the latching bolt may be such that the key is either twisted or broken in the process and entry to the car is denied.

It has been determined that one of the mechanisms acting to create the difficulty in manually unlocking the latching bolts is that when the electric motor, gears and the remainder of the electric drive train to the door lock actuator are mechanically coupled thereto, in order to manually displace the latching bolt, it is necessary to "back drive" the gear train and electric motor as the latching bolt is displaced. Hence, additional force on the key is required and additional work is necessary to accomplish the rotation of the motor armature and the displacement of the gear train of the actuator.

The term "back driven" as used herein defines the physical movement including rotation of the armature of the actuator motor, and the intermediate gearing between the armature and the door locking mechanism occasioned by turning a key to gain entry to a vehicle.

It has also been identified that under emergency conditions there may be times when it is necessary to unlock a car door from the inside and it is desirable to have little or no parasitic loading due to "back driving". Such emergency conditions include an accident or an electrical power source, such as the battery, has become disconnected, or the electric motor has otherwise been rendered inoperative. In these circumstances it is likewise beneficial not to have to manually "back drive" the motor to accomplish unlocking of the vehicle door.

Certain lost motion connecting devices have been utilized to isolate a door lock actuator unit drive from manual operation of a button or handle. For instance in U.S. Pat. No. 4,102,213, there is provided lost motion connection to permit an actuator to cycle even if the door lock lever is being held to preclude movement. This device does not act to isolate manual operation from electric operation to avoid "back driving" forces, but instead is directed as a safety feature so as not to destroy the door lock when the operator manually holds the lock in a locked position when the unlock button is energized.

U.S. Pat. No. 4,290,634 discloses a series of devices for connecting the manual locking and unlocking button in a car to the motive means. A lost motion relationship is disclosed between rack gear 63 and button link 62. Spring 64 is utilize to drive the rack gear to a neutral position such that the button may be displaced without moving the rack gear. In FIGS. 3 and 4 there is disclosed a mechanism for connecting an electric motor to a gear train, which is connected to a manual locking button, wherein the gear train is engaged upon sufficient centrifugal force being applied when the motor is operated. Additionally disclosed in FIGS. 5–8, is a lost motion device utilized without springs. Therein a rotating mechanism having a projection mates with a slot defined by a pair of movable arms such that when the projection is displaced in the correct direction and engages an appropriate arm it causes the device to slide on a shaft. When the rotation direction is in the wrong direction, the arm forming the slot is displaced without causing sliding motion on the shaft, and the rotating member may continue to rotate without effecting such displacement.

It is also known that at least one car manufacturer utilizes an electric door lock actuator which includes an electric motor which drives a rotating mechanism using a spring for latching and unlatching a door. This spring which is a direct part of the drive system is wound when the motor is energized such that when then motor is de-energized the spring unwinds causing the motor to be rotated backwards thereby allowing for manual operation of the locking mechanism without being required to "back drive" the motor. See, for instance, U.S. Pat. No. 4,573,723.

SUMMARY OF THE INVENTION

It is an object of the present invention to provide an electric door lock actuator which provides for a lost motion coupling between electric motive means and a lock mechanism.

It is a still further object of the present invention to provide an electric door lock actuator having a rotating cam cooperating with a pair of spaced projections to define a lost motion device for allowing manual operation of a lock mechanism without causing the motor and the drive means to be "back driven".

It is a further object of the present invention to provide an electric door lock and latch mechanism including bidirectional electric drive means and manual means to lock and unlock said mechanism which allows for the manual means to be utilized without requiring the electric means to be "back driven".

It is yet another object of the present invention to provide a combination door lock actuator and latching means which may be compact and mounted in a single housing and which provides for the desired locking and unlocking motion both in the electric and manual modes of operation.

Another object of the invention is to provide a safe, economical, reliable, and easy to manufacture and assemble electric door lock actuator.

Other objects will be apparent from the description to follow and the appended claims.

The above objects are achieved according to a preferred embodiment by the provision of a door lock system for a motor vehicle including a latching and locking means having a lever which may be displaced between locked and unlocked positions to either secure a door lock or place the door lock in a condition where the door may be opened. A cam means is connected to displace said lever, said cam means being mounted for rotational displacement and defining a fixed receiving slot formed within the cam means. A gear means is mounted for rotational displacement such that said gear means defines at least one projection means sized to engage the cam means within the receiving slot such that rotational displacement of the gear means effects rotational displacement of the cam means. Additionally, means for driving the gear means to effect rotation thereof are provided. A pair of spaced projections may be included on the gear means such that one of the pair engages the receiving slot to drive the cam means in each direction. One of the pair of projection means may likewise engage a partial cylindrical surface defined by the cam to terminate operation in either the locked or unlocked direction. Once the door latching mechanism is placed in either the unlocked or locked position, the cylindrical surface of the cam means abuts against or is positioned adjacent to a projecting means such that the projection means does not extend within the slot and the cam means may be rotated relative to the gear means without engaging same, such that manual operation of the locking means does not require the motor to be "back driven".

Additionally, disclosed is an electric door lock actuator for driving a door latch locking means. The actuator includes a bidirectional electric motor drive having a pinion gear, gear means mounted to engage the pinion gear such that rotation of the pinion gear causes rotation of the gear means, said gear means including at least one projection means extending therefrom, a cam means mounted for rotational displacement, said cam means defining a receiving slot sized to receive the projection means from the gear means whereby rotation of the gear means may effect rotation of the cam means, and coupling means for coupling the door latch locking means to the cam means such that rotation of the cam means acts to lock or unlock the door latch locking means.

DESCRIPTION OF THE PREFERRED EMBODIMENT

The invention herein will be described with reference to a specific lost motion coupling and the specific means for effecting displacement of a latching and locking mechanism and for allowing lost motion between that mechanism and an electric drive means.

Although as shown in the Figures as two separate structures connected by connecting rod 3, the latching and locking mechanism and the door lock actuator may be combined in a single integral unit eliminating the lengthy connecting linkages extending therebetween. The choice of whether to build a door lock system having two separate units or a single unit is a design choice for each application.

Figure 1:
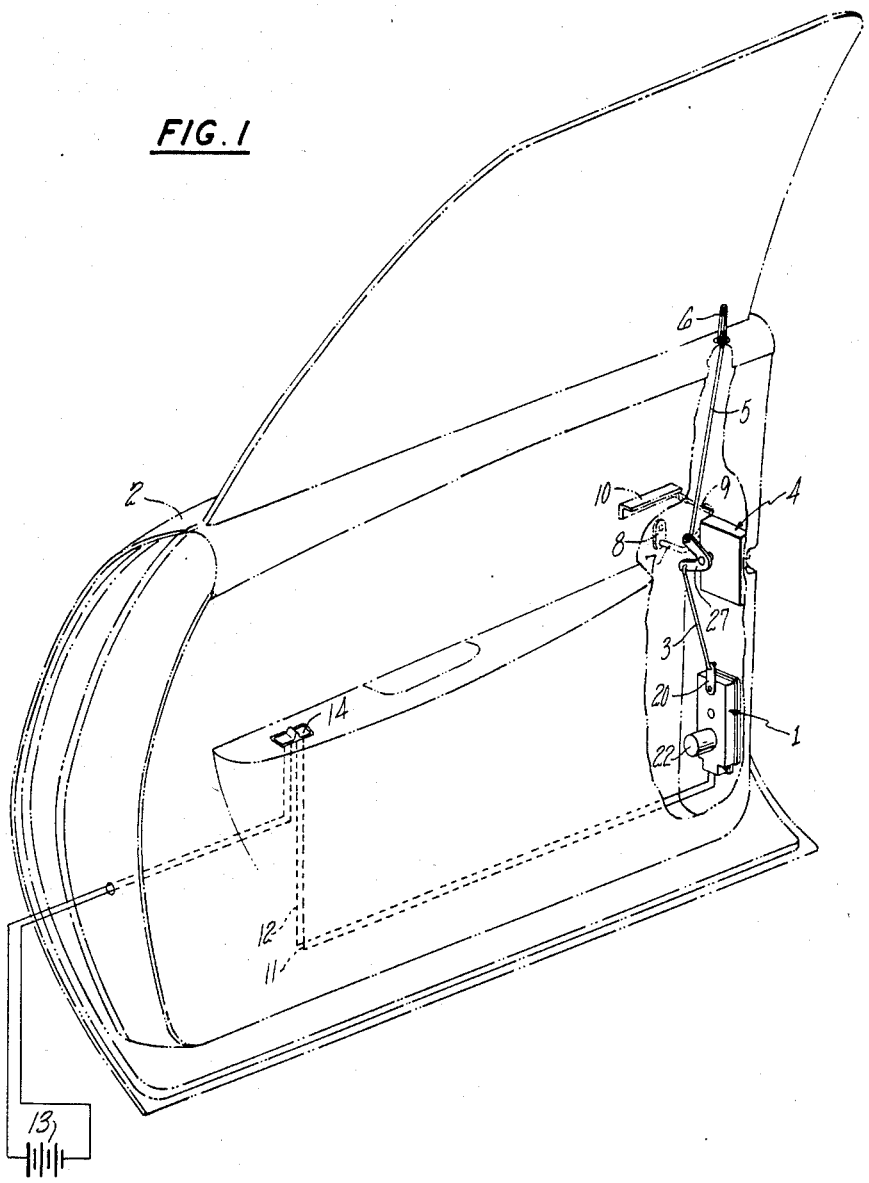
FIG. 1 is a perspective view of an automobile door showing the typical location of the door latching and locking mechanism, the electric door lock actuator and control switch and circuit therefor.

Referring to FIG. 1, an electrically powered door lock actuator 1 is shown mounted between the inner and outer panels of automobile door 2. Connecting link 3 extends from the actuator to door latching and locking mechanism 4. The connecting link is driven back and forth by the actuator to engage and disengage the lock. Connecting rod 5 extends from the latch and lock mechanism to manual control button 6 located near the bottom edge of the window. This button is used to manually lock and unlock the door latching mechanism. Connecting rod 7 extends from the latch and lock mechanism to a key operated actuator 8 that is accessible from the exterior of the automobile. Connecting rod 9 which extends from the latch and lock mechanism to door handle 10, is used to unlatch the door.

Conductors 11 and 12 supply current to the actuator from battery 13 through a double pole, double throw control switch 14 located on the inner panel of the door. This arrangement of the various elements just described can be considered typical for an automobile door, although slight variations in the location of the components may vary from one type of automobile to another. Almost without exception, however, there will be a means to manually unlatch a door from inside and outside the door, and manual means to lock and unlock the latching means which will be located inside the door and outside the door.

In automobiles which have electric door lock actuators, the electric actuator is mounted within the door and is connected by a linkage to the manually-actuated locking mechanism. A control switch for the electric actuator is mounted inside the automobile and is usually located in the inside panel of the door. Also, on some later model automobiles, an electrical switch is also incorporated in the key actuator so that when a key is inserted in the slot, the switch is closed which causes the electric actuator to unlock the latch. Additionally, as mentioned hereinbefore, the door lock actuator and the latch and lock mechanism may be a single combination of elements within a single housing positioned to appropriately control both latching and locking of the automobile door.

Figure 2:
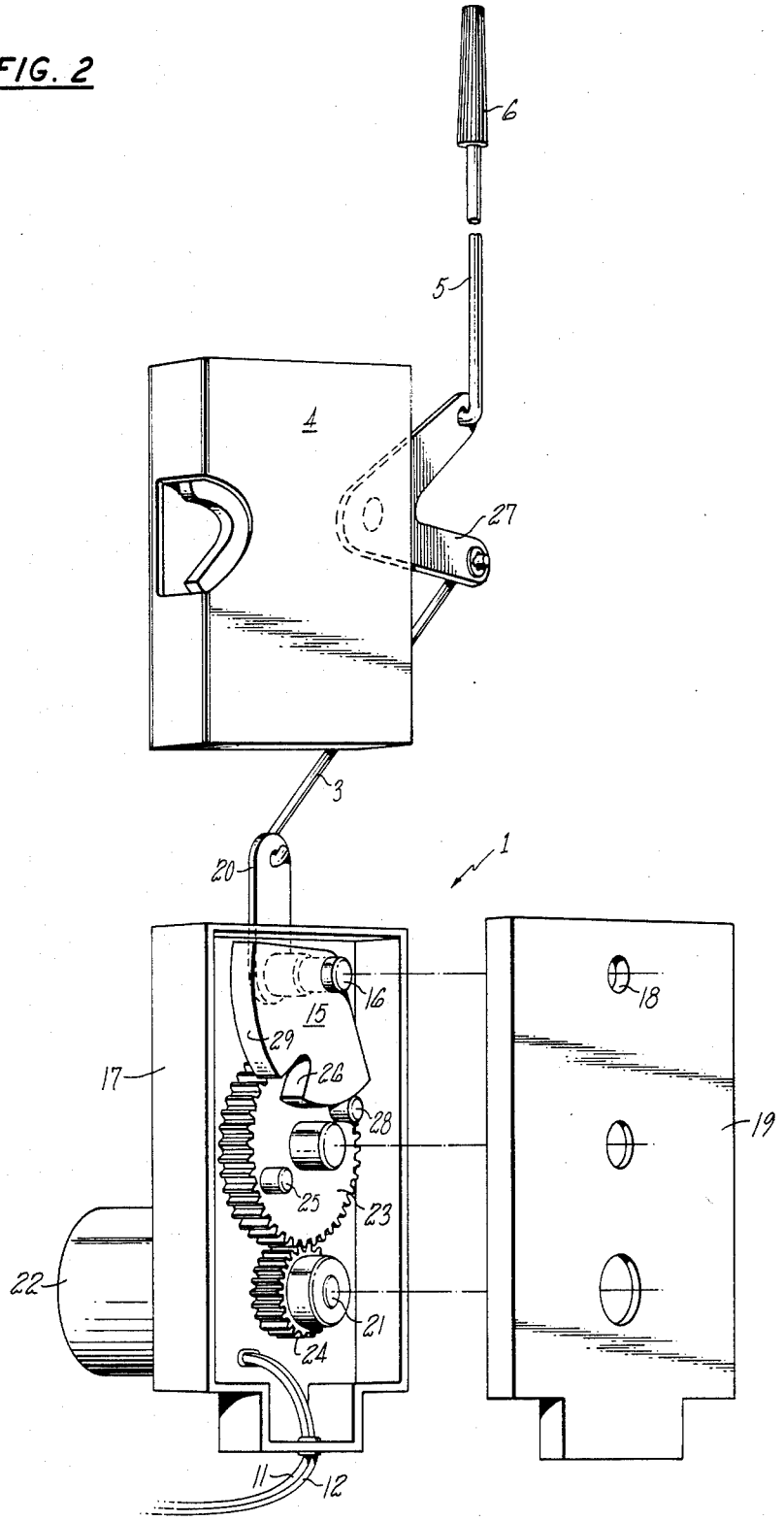
FIG. 2 is a perspective view of a latching and locking mechanism and a door lock actuator shown connected by a connecting rod together with the cover for the door lock actuator. The latching and locking mechanism is shown in the unlocked position.
Figure 3:
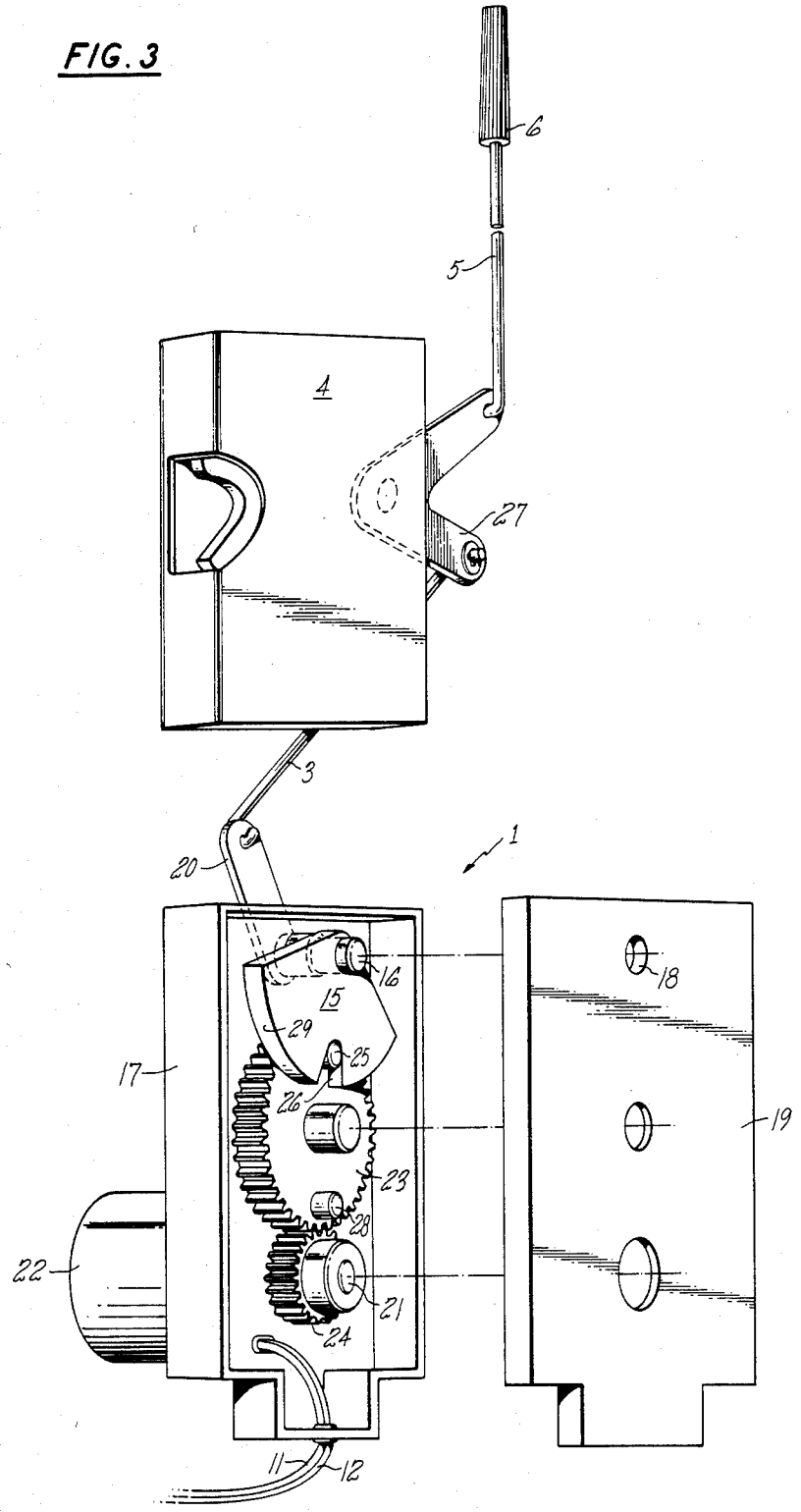
FIG. 3 is the same view as FIG. 2 with the latching and locking mechanism shown midway between the locked and unlocked position.
Figure 4:
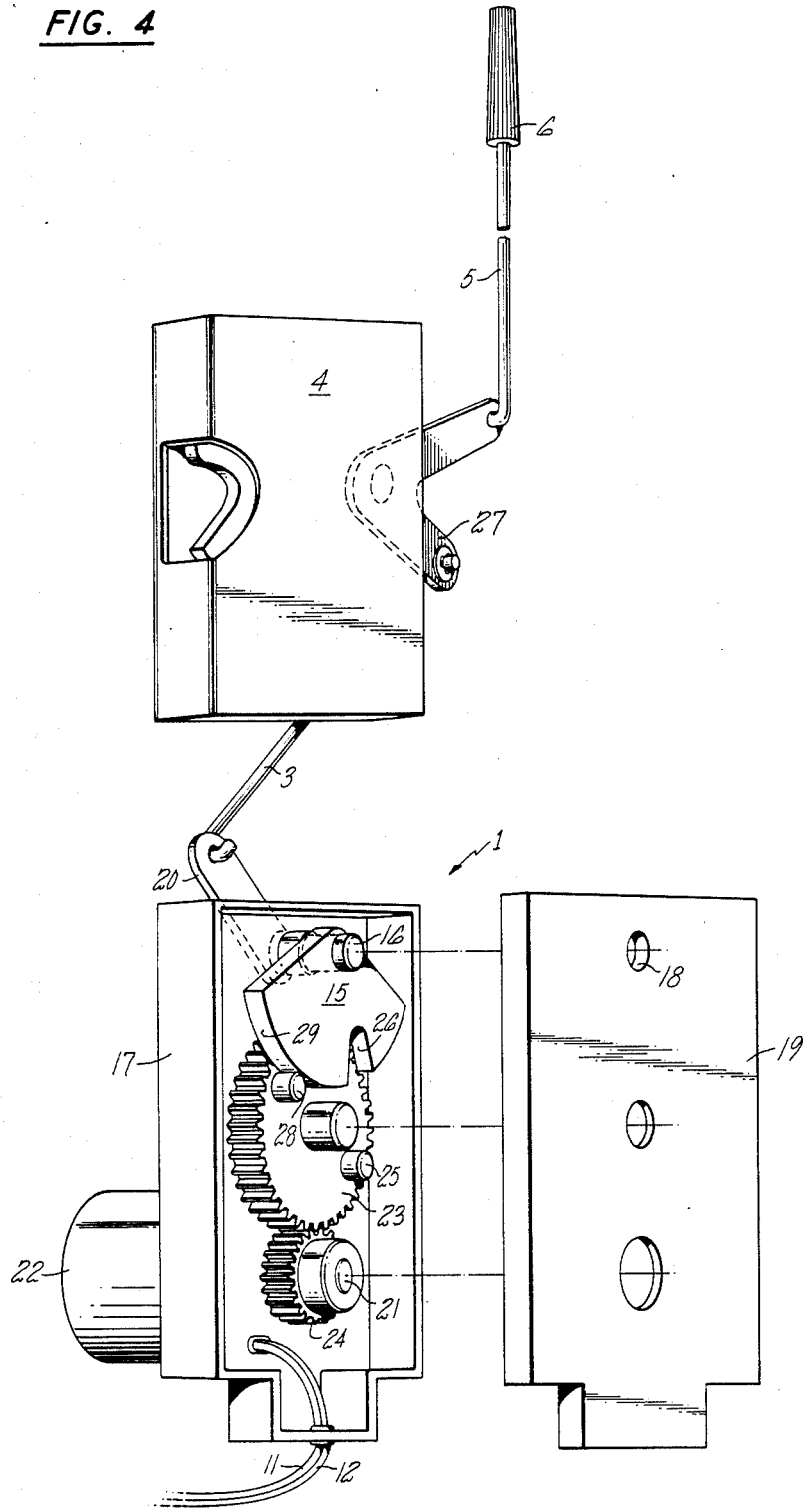
FIG. 4 is the same view as FIG. 2 with the latching and locking mechanism shown in the locked position.

FIGS. 2–4 show a detailed view of the electric door lock actuator and latching and locking mechanism in the unlocked, midway and locked positions respectively. Turning first to FIG. 2, there may be seen latching and locking mechanism 4 having lever 27 rotationally positioned to cause connecting rod 5, connected to button 6, to be displaced upwardly and downwardly, depending upon the position of lever 27.

Door lock actuator 1 is shown having a first portion of housing 17 to which the components are mounted and a cover portion 19 shown spaced therefrom. Cover portion 19 defines an opening 18 in the cover portion for the receipt of pin 16 projecting from cam 15.

Mounted to the first portion of the housing is shown motor 22 including shaft 21 mounted for rotational motion in both directions relative to the motor housing and having pinion gear 24 secured to the shaft. Conductors 11 and 12 are shown running to the motor. Electric current of the appropriate polarity may be applied thereto to cause the motor to operate in the desired direction to effect locking or unlocking of the automobile door. Gear 23 is mounted for rotational displacement and includes projections or pins 25 and 28 extending outwardly therefrom. Mounted adjacent to gear 23 is cam 15. Cam 15 defines a partial cylindrical surface 29 and slot 26. The cam additionally includes pin 16. Arm 20 is secured to cam 15 such that rotation of the cam effects rotation of the arm which, through connecting link 3, acts to displace lever 27 of the latching and locking means to effect locking or unlocking of the latching means.

In FIG. 2, the actuator and the latching and locking mechanism are shown with the mechanism in the unlocked position. To be placed in this position, arm 20 has been displaced upwardly to cause lever 27 to be rotated in a counterclockwise direction. To place arm 20 in this position, motor 22 was operated to drive pinion gear 24 which drives gear 23 in a counterclockwise direction such that pin 25 engaged slot 26, and as pin 25 was rotated in a counterclockwise direction, slot 26 and cam 15 were caused to rotate in a clockwise direction to obtain the desired motion.

The motor acts to drive the pinion to drive gear 23 such that projection 25 not only displaces cam 15, but continues in a counterclockwise direction until such time as projection 25 is separated therefrom. Such time may be determined by pin 28 contacting cylindrical surface 29 of the cam. At this time motor operation is stopped and it is known that the lever 27 is in the unlocked position.

To effect locking of the door, the motor is operated in the opposite direction and gear 23 is driven in the opposite direction. In this instance, projection 25 engages slot 26 as it is rotated in the clockwise direction and causes cam 15 to be rotated in the counterclockwise direction. FIG. 3 shows the projection engaged in the slot with the locking mechanism in the midway position.

Looking now to FIG. 4, it may be seen that pin 25 has been rotated in the clockwise direction and has displaced cam 15 to the locked position and rotation has continued until pin 28 engages cylindrical surface 29 of the cam and causes the motor to be deactuated, said projection 25 being outside of the slot at this time. In FIG. 4, it may be seen that the button 6 and lever 27 are arranged in the locked position. It also may be seen that when the latching and locking mechanism is in the locked or unlocked position that neither projection is engaged within slot 26 such that manual operation of button 6 may cause lever 27 to rotate which causes arm 20 and connected cam 15 to rotate. However, since no projection is positioned within slot 26, the cam may rotate without effecting rotation of gear 23 or of shaft 21 connected to the armature of the motor. Hence, manual operation of the latching and locking mechanism does not effect "back drive" of the motor.

The invention has been described with reference to a particular embodiment. It is to be understood by those skilled in the art that variations and modifications can be made within the spirit and scope of the invention.

I claim:

1. A door lock system for a motor vehicle which comprises:

a latching and locking means having a lever which may be displaced between locked and unlocked positions to either a latch the door lock or place the door lock in a condition where the door may be opened;

a cam means connected to displace said lever, said cam means being mounted for rotational displacement and defining only one fixed receiving slot formed within said cam means;

a gear means mounted for rotational displacement and offset from the cam means to overlap therewith, said gear means including at least one projecting pin means extending axially outward from a radially extending surface of the gear means and sized to engage the cam means within the receiving slot such that rotational displacement of the gear means effects rotational displacement of the cam means and continued rotational displacement of the gear means disengages the projecting pin means from the slot; and means for driving the gear means to effect rotational displacement thereof whereby when the projecting pin means is not in the slot, the cam means may be displaced as a result of displacement of the latching and locking means lever without causing rotational displacement of the gear means or the means for driving the gear means.

2. The apparatus as set forth in claim 1 wherein at least one projecting pin means includes a first projecting pin means projecting from the gear means in a direction parallel to the axis of rotation of the gear means and sized to engage the cam means within the receiving slot and wherein the means for driving the gear means further comprising means for driving the gear means in opposite rotational directions such that in a first direction the first projecting pin means engages the cam and causes the cam to rotate in one direction and in a second direction the first projecting pin means engages the cam and causes the cam to rotate in a second opposite direction.

3. The apparatus as set forth in claim 2 wherein the means for driving is a bidirectional electric motor including a pinion gear mounted to the armature thereof and wherein said motor and pinion gear are positioned to have the pinion gear mate with the gear means for effecting displacement thereof.

4. The apparatus as set forth in claim 2 wherein the cam defines a partial cylindrical surface, wherein the slot extends inwardly from said surface and wherein upon the latching and locking means being in either the locked or unlocked position, the projecting pin means is not positioned within the slot and the cam means may be freely displaced without engagement of the cam means to the gear means.

5. The apparatus as set forth in claim 4 and further including a second projecting pin means extending from said gear means wherein the gear means may be rotationally displaced to effect movement of the cam means and may continue to be rotationally displaced until the second projecting pin means engages the partial cylindrical surface indicating that the door lock system has been completely displaced to the locked or unlocked positions.

6. An electric door lock actuator for driving a door latch locking means including means for allowing manual operation of the latch locking means with a minimum of force which comprises:

a bidirectional electric motor drive including a pinion gear;

a gear means mounted to engage the pinion gear such that rotation of the pinion gear causes rotation of the gear means, said gear means including at least one projecting pin means extending therefrom;

a cam means mounted for rotational displacement and offset from the gear means to overlap therewith, said cam means defining only one receiving slot sized to receive the projecting pin means from the gear means whereby rotation of the gear means may effect rotation of the cam means;

said projecting pin means including a pin extending axially outwardly from a radially extending surface of the gear means and being positioned to coact with the receiving slot to impart motion to the cam means upon selected rotation of the gear means to disengage from the slot upon continued rotation of the gear means to allow the gear means and cam means to be independently displaced; and coupling means for coupling the door latch locking means to the cam means such that rotation of the cam means acts to lock or unlock the door latch locking means and such that manual actuation of the door latch locking means is achieved with a minimum of force by allowing the cam means to be displaced without displacing the gear means or the motor drive when the projecting pin means is not engaged in the slot.

7. The apparatus as set forth in claim 6 wherein the gear means further comprises at least two spaced-apart projecting pin means and wherein the cam means defines a partial cylindrical surface, wherein the slot extends inwardly form the partial cylindrical surface and wherein one of the spaced projecting pin means engages the slot to displace the cam means in a first direction and when the motor drive is operated in the opposite direction, said projecting pin means engages the slot to displace the cam means in a second direction.

8. The apparatus as set forth in claim 7 wherein the projecting pin means are appropriately spaced such that when operation of the drive is initiated, a projecting pin means is rotated into engagement with the slot, rotated to displace the cam defining the slot and is rotated out of engagement with the slot and continues to be rotated until the other projecting pin means abuts against the partial cylindrical surface thereby stopping the operation of the drive.

9. The apparatus as set forth in claim 8 wherein when the locking means is either in a locked position or an unlocked position, neither projecting pin means is engaged within said slot such that manual operation of the locking means allows the cam means to be rotated without rotating the gear means or the motor drive.

10. The apparatus as set forth in claim 6 wherein the coupling means comprises a lever arm connected to rotate with the cam means and further comprising a connecting link extending between the lever arm and the door latch locking means to translate displacement therebetween.

* * * * *